US012790153B2

(12) United States Patent
Nakagawa

(10) Patent No.: US 12,790,153 B2
(45) Date of Patent: Nov. 10, 2026

(54) SHEET CONVEYANCE APPARATUS AND IMAGE FORMING APPARATUS

(71) Applicant: CANON KABUSHIKI KAISHA, Tokyo (JP)

(72) Inventor: Hiroyuki Nakagawa, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/821,856

(22) Filed: Aug. 30, 2024

(65) Prior Publication Data

US 2025/0083915 A1 Mar. 13, 2025

(30) Foreign Application Priority Data

Sep. 7, 2023 (JP) ..... 2023-145660

(51) Int. Cl.
*B65H 11/02* (2006.01)
*B65H 1/04* (2006.01)
(Continued)

(52) U.S. Cl.
CPC ..... *B65H 11/007* (2013.01); *B65H 11/02* (2013.01); *B65H 2402/31* (2013.01); *B65H 2801/06* (2013.01)

(58) Field of Classification Search
CPC ..... B65H 11/02; B65H 2403/60; B65H 2403/61; B65H 2403/5331;
(Continued)

(56) References Cited

U.S. PATENT DOCUMENTS

2006/0120756 A1* 6/2006 Ahn ..... G03G 21/1633 399/124
2016/0159588 A1* 6/2016 Mizuguchi ..... G03G 21/1633 271/147

(Continued)

FOREIGN PATENT DOCUMENTS

JP 2007106506 A * 4/2007
JP 2008024396 A 2/2008
JP 2016133615 A * 7/2016

OTHER PUBLICATIONS

English Translation of JP 2007-106506 A (Year: 2026).*

*Primary Examiner* — Luis A Gonzalez
(74) *Attorney, Agent, or Firm* — Canon U.S.A., Inc. IP Division

(57) ABSTRACT

A sheet conveyance apparatus includes a housing configured to store a sheet conveyance unit for conveying a sheet, an opening/closing unit configured to be openably and closably provided with respect to the housing, and pivotable between a closed position and an opened position, and a damping unit that is included in the opening/closing unit and configured to damp a movement of the opening/closing unit from the closed position to the opened position, wherein when the opening/closing unit is in the closed position, the opening/closing unit is not subjected to a resistance force of applying a load to the movement of the opening/closing unit by the damping unit, and wherein when the opening/closing unit is pivoted from the closed position to the opened position, the opening/closing unit is subjected to the resistance force of applying the load to the movement of the opening/closing unit by the damping unit.

11 Claims, 7 Drawing Sheets

(51) Int. Cl.
*B65H 11/00* (2006.01)
*G03G 21/16* (2006.01)

(58) Field of Classification Search
CPC ..... B65H 2405/324; B65H 2407/21; B65H 1/04; G03G 15/6514; G03G 21/1633; G03G 21/1628; G03G 21/1638
See application file for complete search history.

(56) References Cited

U.S. PATENT DOCUMENTS

| | | | | |
|---|---|---|---|---|
| 2020/0131826 | A1* | 4/2020 | Connors | F16H 19/04 |
| 2021/0047139 | A1* | 2/2021 | Kannari | B65H 1/04 |
| 2023/0219776 | A1* | 7/2023 | Iwami | B65H 3/128 271/18 |

* cited by examiner

SHEET CONVEYANCE APPARATUS AND IMAGE FORMING APPARATUS

BACKGROUND

Field

The present disclosure relates to a sheet conveyance apparatus that conveys sheets, and an image forming apparatus using the sheet conveyance apparatus.

Description of the Related Art

There have been conventionally widespread image forming apparatuses, such as printers and copiers, that are equipped with a manual sheet feeding device in which a manual feed tray (opening/closing unit) for placing sheets is provided on one side of the main body of the apparatus to supply sheets one by one to an image forming unit.

The manual feed tray is, for example, opened and closed by being pivoted relative to the main body of the apparatus. The manual feed tray can be pivoted from its storage position stored in the main body of the apparatus when no manual feed is performed, and to its feed position where the manual feed tray is opened from the main body of the apparatus to manually feed sheets.

When the manual feed tray is opened, the feed position is held by an arm member, for example. One end of the arm member is swingably provided on the main body of the apparatus, and the other end is guided in a guide groove provided in the manual feed tray.

Japanese Patent Application Laid-Open No. 2008-24396 discusses a manual sheet feeding device in which a tension coil spring is disposed, one end of the tension coil spring being attached to the manual feed tray and the other end being attached to the arm member, as a configuration that reduces the impact caused when the manual feed tray is opened to the feed position from the storage position.

When the manual tray is opened to the feed position, the tension coil spring applies an elastic force in the direction opposite to the direction where the other end of the arm member is moved in the guide groove, which reduces the impact caused when the manual tray is opened.

On the other hands, in recent years, there has been increased demand for diversification in sheet types and sizes image forming apparatuses support. As a result, manual sheet feeding devices that enable feeding various sheets are called for, which causes a trend toward larger manual feed trays.

Some manual feed trays can weigh more due to increase in the number of parts to be more multifunctional. Since the manual sheet feeding device discussed in Japanese Patent Application Laid-Open No. 2008-24396 reduces the impact using an elastic force of the coil spring alone, a heavier manual feed tray entails a stronger coil spring.

The urging force of the coil spring acts in the direction where the manual feed tray is closed, even when the manual feed tray is in the feed position. A too large urging force of the coil spring can affect the operability, such as an example where the manual feed tray in the feed position is unintentionally closed by a user.

SUMMARY

The present disclosure is directed to providing a sheet conveyance apparatus and an image forming apparatus that achieve both operability and reduction in the impact caused when an opening/closing unit is opened.

According to some embodiments, a sheet conveyance apparatus includes a housing configured to store a sheet conveyance unit for conveying a sheet, an opening/closing unit configured to be openably and closably provided with respect to the housing, and pivotable between a closed position and an opened position, and include a support part that supports the sheet at the opened position, a feed unit configured to feed the sheet supported by the support part, and a damping unit that is included in the opening/closing unit and configured to damp a movement of the opening/closing unit from the closed position to the opened position, wherein when the opening/closing unit is in the closed position, the opening/closing unit is not subjected to a resistance force of applying a load to the movement of the opening/closing unit by the damping unit, and wherein when the opening/closing unit is pivoted from the closed position to the opened position, the opening/closing unit is subjected to the resistance force of applying the load to the movement of the opening/closing unit by the damping unit.

Further features of the present disclosure will become apparent from the following description of exemplary embodiments with reference to the attached drawings.

DESCRIPTION OF THE EMBODIMENTS

Figure 1:
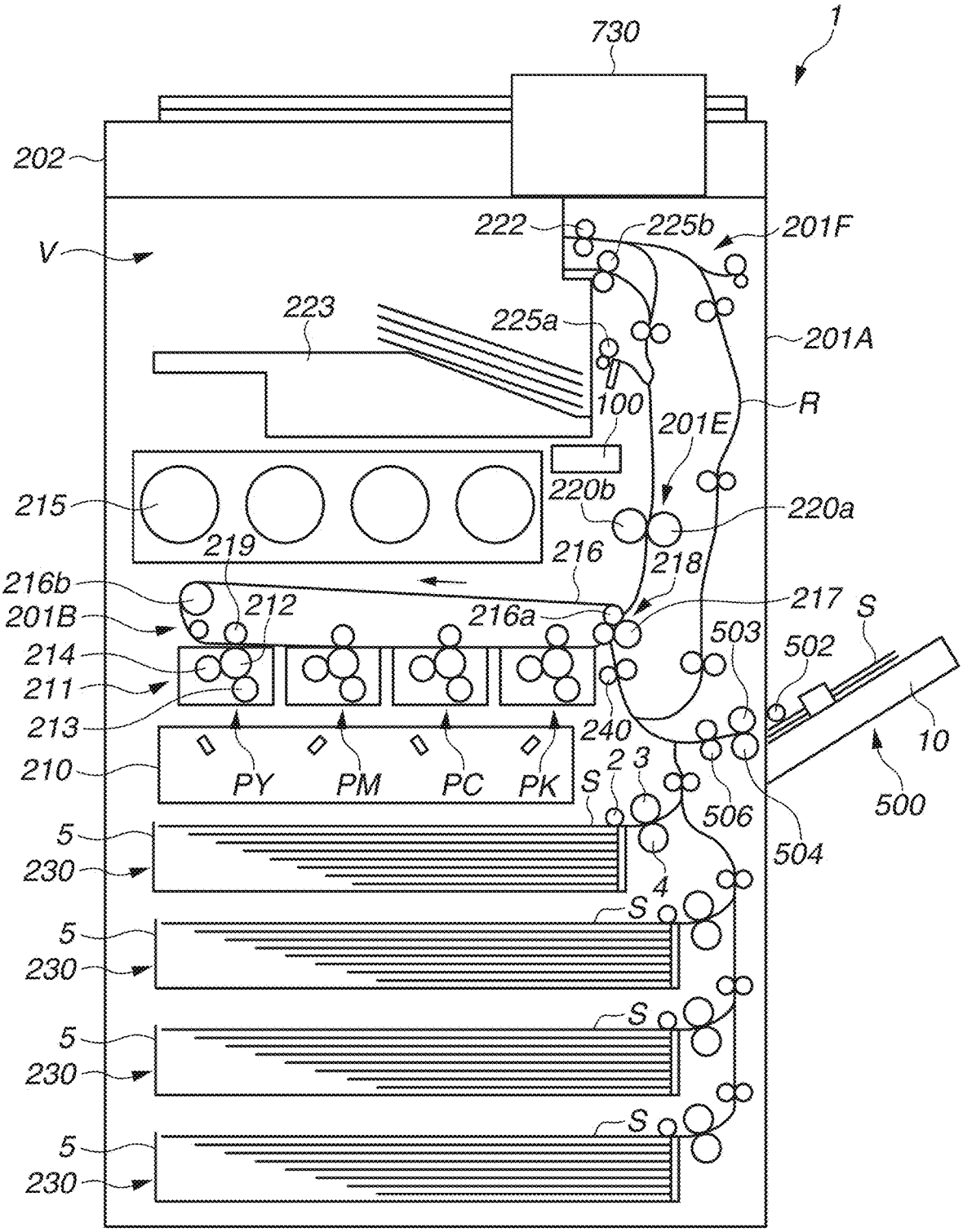
FIG. 1 is a schematic cross-sectional view of an image forming apparatus according to an exemplary embodiment.

Various exemplary embodiments, features, and aspects of the present disclosure will now be described with reference to the drawings. First, the schematic configuration of an image forming apparatus 1 according to the present exemplary embodiment is described with reference to FIG. 1. FIG. 1 is a cross-sectional view of the schematic configuration of the image forming apparatus 1 according to the present exemplary embodiment. The image forming apparatus 1 is a tandem intermediate transfer laser beam printer that utilizes an electrophotographic process. The image forming apparatus 1 can form a full-color or monochrome image corresponding to print image data output from a host device connected to a control unit 100, and output the image on a sheet S as a recording medium.

The control unit 100 is a control unit for performing the general control of operations of the image forming apparatus 1, and transmits and receives information to and from the host device and an operation unit 730. The control unit 100 also performs signal processing and sequence control of various processing devices. The host device here is a personal computer, an image scanner, a facsimile, for example. The control unit 100 includes a central processing unit (CPU), a random access memory (RAM), and a read only memory (ROM), and controls components in the image forming apparatus 1. The CPU outputs output signals to electric components to be operated at desired timings and by amounts of control, based on detection signals input from sensors and information stored in the ROM. Thus, the CPU controls the electric components. The ROM and RAM store information data for controlling components, and the CPU reads and writes information data respectively from the ROM and to the RAM.

The image forming apparatus 1 includes an apparatus main body 201A, and an image forming unit 201B that forms images on sheets S. An image reading device 202 is disposed substantially horizontally over the apparatus main body 201A. A discharge space V for discharging sheets is disposed between the image reading device 202 and the apparatus main body 201A. In the present exemplary embodiment, the apparatus main body 201A, more specifically, the frame of the apparatus main body 201A is an example of a housing. In the present exemplary embodiment, the image forming apparatus 1 is also an example of a sheet conveyance apparatus. Thus, the image forming apparatus 1 as a sheet conveyance apparatus includes the apparatus main body 201A, a manual feed unit 500, a support arm 11, and a feed unit 507 (see FIG. 3A).

Cassette feed units 230 each feed the sheets S from the corresponding feed cassette 5 as a sheet storage unit for storing the sheets S. Each of the cassette feed units 230 includes a pickup roller 2, and a pair of separation rollers composed of a feed roller 3 and a retard roller 4 for separating a sheet S conveyed by the pickup roller 2.

The manual feed unit 500 feeds the sheets S from a manual feed tray 10 that holds sheets S. The manual feed unit 500 is an example of an opening/closing unit. The manual feed unit 500, which can be opened/closed by pivoting with respect to the apparatus main body 201A, is mounted to the apparatus main body 201A and pivotable from a position stored in the apparatus main body as a storage position (closed position) and to a position opened from the apparatus main body where the sheets S are conveyed as a feed position (opened position). The manual feed unit 500 includes the manual feed tray 10. The manual feed tray 10 is an example of a support portion, supporting sheets when the manual feed unit 500 is at the opened position.

The feed unit 507 includes a pickup roller 502 that feeds the sheets placed on the manual feed tray 10, and a pair of separation rollers that separate a sheet S conveyed by the pickup roller 502. The pair of separation rollers consists of a feed roller 503 and a retard roller 504. The sheets separated one by one via the pair of the separation rollers are conveyed to a pair of registration rollers 240 by a pair of conveyance rollers 506. That is, the feed unit 507 feeds the sheets supported by the manual feed tray 10 to the pair of conveyance rollers 506. In the present exemplary embodiment, the pair of conveyance roller 506 is an example of a sheet conveyance unit for conveying sheets, and is housed in the apparatus main body 201A.

The image forming unit 201B forms an image on a sheet fed from one of the cassette feed units 230 or the manual feed unit 500. In other words, the image forming unit 201B forms an image on a sheet conveyed by the pair of conveyance rollers 506. The image forming unit 201B employs a four-drum full-color method, and includes a laser scanner 210 and four process cartridges 211 that form toner images of four colors, yellow (Y), magenta (M), cyan (C), and black (K). Each of the process cartridges 211 includes a photosensitive drum 212, a charger 213 as a charging unit, and a developer 214 as a developing unit. The image forming unit 201B also includes a secondary transfer unit 218 arranged above the process cartridges 211, and a fixing unit 201E. Similar to the process cartridges 211, toner cartridges 215 store toners of four colors, yellow (Y), magenta (M), cyan (C), and black (K), and supply the toners to the developer 214.

The secondary transfer unit 218 includes a transfer belt 216 stretched around a drive roller 216*a* and a tension roller 216*b*. Primary transfer rollers 219 are provided inside the transfer belt 216, and are in contact with the transfer belt 216 at positions facing the photosensitive drums 212. The transfer belt 216 is rotated in the direction of the arrow by the drive roller 216*a* being driven by a drive unit. A secondary transfer roller 217, which transfers a color image formed on the transfer belt 216 to the sheet S, is provided at a position facing the drive roller 216*a* of the secondary transfer unit 218.

The fixing unit 201E is arranged above the secondary transfer roller 217. A pair of first discharge rollers 225*a*, a pair of second discharge rollers 225*b*, and a double-sided reversing unit 201F are arranged above the fixing unit 201E to discharge sheets. The double-sided reversing unit 201F includes a pair of reversing rollers 222 that rotates forward and reversely, and a re-conveyance path R for conveying the sheet S with an image formed on one side to the image forming unit 201B again. The operation unit 730 for receiving user operations is provided at the top of the image forming apparatus 1. The operation unit 730 employs a touch panel method that has both a display function and an input function.

An image forming operation of the image forming apparatus 1 will now be described. Upon reception of image data on an original document to be printed, the image forming apparatus 1 processes and converts the image information into an electric signal, and transmits the electric signal to the laser scanner 210 of the image forming unit 201B. In the image forming unit 201B, the surfaces of the photosensitive drums 212 uniformly charged to predetermined potentials of one polarity by the chargers 213 are sequentially exposed to laser beams. Accordingly, electrostatic latent images of yellow, magenta, cyan, and black are sequentially formed on the photosensitive drums of the process cartridges 211, respectively.

The electrostatic latent images are developed with toners of the colors to be visible, and the color toner images on the photosensitive drums are sequentially superimposed and transferred to the transfer belt 216 by primary transfer biases applied to the primary transfer rollers 219. This forms toner images on the transfer belt 216.

In parallel with the toner image forming operation, the sheets S are conveyed one by one with one of the cassette feed units 230 or the manual feed unit 500 to the pair of registration rollers 240, and a skew of each sheet is corrected by the pair of registration rollers 240. After the skew is corrected, the sheet S is conveyed by the pair of registration rollers 240 to the secondary transfer unit 218, and the toner images are all transferred at once to the sheet S by a secondary transfer bias applied to the secondary transfer roller 217 of the secondary transfer unit 218.

The sheet S with the toner images thereon is conveyed to the fixing unit 201E, where the toners of the respective colors are melted and mixed under heat and pressure at a roller nip portion formed between a pressure roller 220*a* and a heating roller 220*b*. The color toners on the sheet S are fixed as a color image. The sheet S with the color image thereon is discharged to the discharge space V via the pair of first discharge rollers 225*a* or the pair of second discharge rollers 225*b* provided downstream of the fixing unit 201E, and are neatly stacked on a discharge tray 223, which protrudes from the bottom of the discharge space V. In a double-sided image formation, when the image is fixed on one side of the sheet S, the sheet S is conveyed to the re-conveyance path R via the pair of reversing rollers 222, and is conveyed again to the image forming unit 201B.

[Manual Feed Unit]

Figure 2:
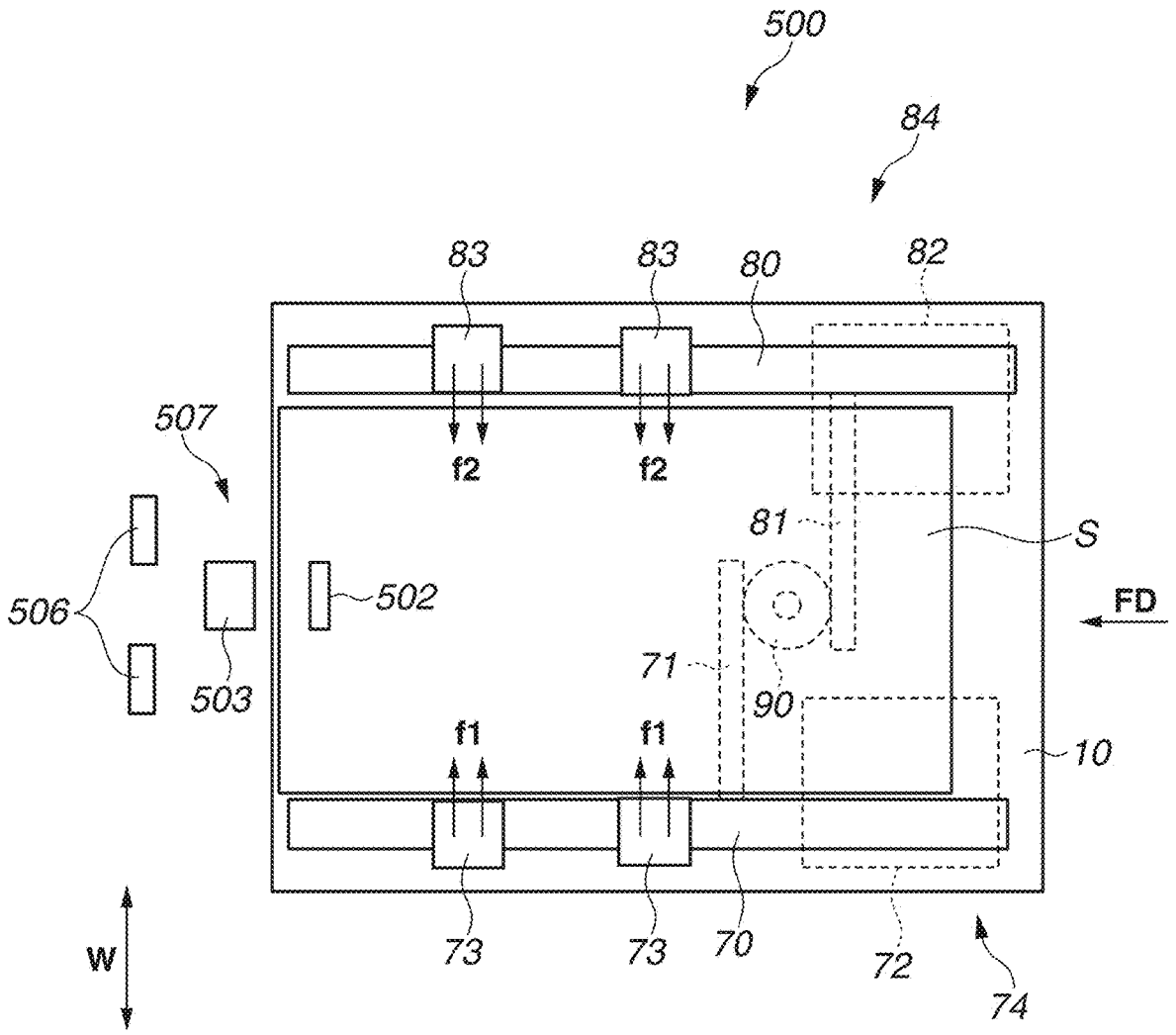
FIG. 2 is a plan view of a manual feed tray at opened position according to the exemplary embodiment.

The manual feed unit 500 will be described with reference to FIG. 2. As illustrated in FIG. 2, the manual feed unit 500 includes the manual feed tray 10, the pickup roller 502, and a pair of a first side regulation part 70 and a second side regulation part 80. The manual feed tray 10 is disposed on one side of the apparatus main body 201A, and openable/closable by pivoting. The main feed tray 10 is shifted to the feed position where a user can feed sheets by opening the manual feed tray 10 from the storage position stored in the apparatus main body 201A. The manual feed tray 10 at the opened position will be described in the following.

The pickup roller 502 feeds sheets S placed on the manual feed tray 10. The pair of the first side regulation part 70 and the second side regulation part 80 is arranged on both sides of the sheets S in a width direction W intersecting with a feeding direction FD of the sheets S placed on the manual feed tray 10, and regulates the position of the sheet S in the width direction W. The first side regulation part 70 is an example of a regulation part, which is provided movable on the manual feed tray 10 and abuts on one end of the sheet S placed on the manual feed tray 10 in the width direction W. The second side regulation part 80 is provided movable together with the first side regulation part 70 and abuts on the other end of the sheet S placed on the manual feed tray 10 in the width direction W. In the present exemplary embodiment, the width direction W is a direction perpendicular to the feeding direction FD of the sheet S.

The first side regulation part 70 includes a rack 71. Similarly, the second side regulation part 80 includes a rack 81. The racks 71 and 81 are meshed with a pinion gear 90 to work together. This allows at least one of the first side regulation part 70 and the second side regulation part 80 to be movable in the width direction W. In the present exemplary embodiment, both the first side regulation part 70 and the second side regulation part 80 are movable together in the width direction W of the sheet S. The first side regulation part 70 or the second side regulation part 80 can be fixed unmovably. In some embodiments, the first side regulation part 70 can be movably provided alone without the second side regulation part 80 being provided.

The first side regulation part 70 includes a first air loosening part 74 that includes a fan motor 72 and blowing nozzles 73. The fan motor 72 causes air f1 to be blown out of the blowing nozzles 73 for one side of a bundle of sheets placed on the manual feed tray 10. The air f1 is brown as loosening air through the fan motor 72 toward the one side of the sheets S, lifting upper sheets of the sheets S in a bundle to reduce the adhesion force between the sheets S. Thus, the first air loosening part 74 is an example of an air loosening part, which blows air in the width direction W from the first side regulation part 70 to the sheets S in a bundle supported by the manual feed tray 10 to loosen the sheets S.

Similarly, the second side regulation part 80 includes a second air loosening part 84 that includes a fan motor 82 and blowing nozzles 83. The fan motor 82 causes air f2 to be blown out of the blowing nozzles 83 for the opposite side of the sheets in a bundle placed on the manual feed tray 10 from the first side regulation part 70. When the air f2 is blown as loosening air out of the fan motor 82 toward the other side of the sheets S, lifting upper sheets of the sheets S in a bundle effectively to reduce the adhesion force between the sheets S, together with the air f1 blown from the opposite side. The fan motors 72, 82, the racks 71, 81, and the pinion gear 90 are arranged opposite to the sheet placement side of the manual feed tray 10. The fan motor 72 and the first side regulation part 70 are movable together in the width direction, as are the fan motor 82 and the second side regulation part 80.

When a user selects the manual feed unit 500 to use and an operation for image formation is started, the manual feed unit 500 starts sheet feeding. If the sheets S placed on the manual feed tray 10 are coated paper, for example, the fan motors 72 and 82 are operated. This allows the airs f1 and f2 to be respectively blown out of the blowing nozzles 73 and 83 to both the sides of the sheets in a bundle in the width direction W.

Figure 3A:
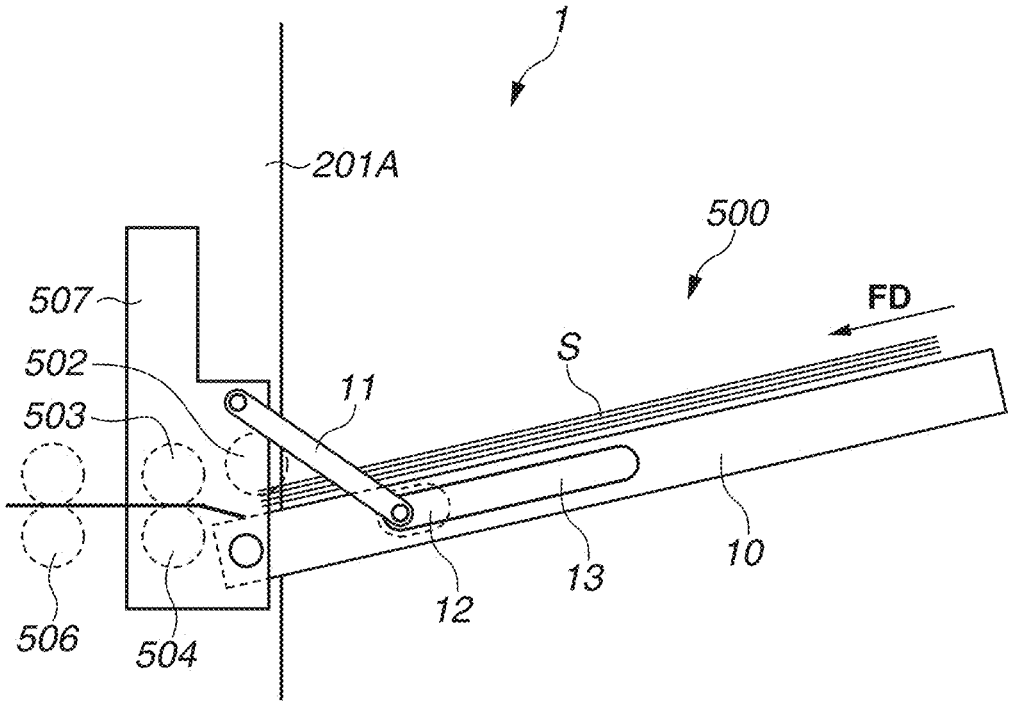
FIG. 3A is a front view of the manual feed tray at the opened position according to the exemplary embodiment, in which sheets and a feed unit are also illustrated.
Figure 3B:
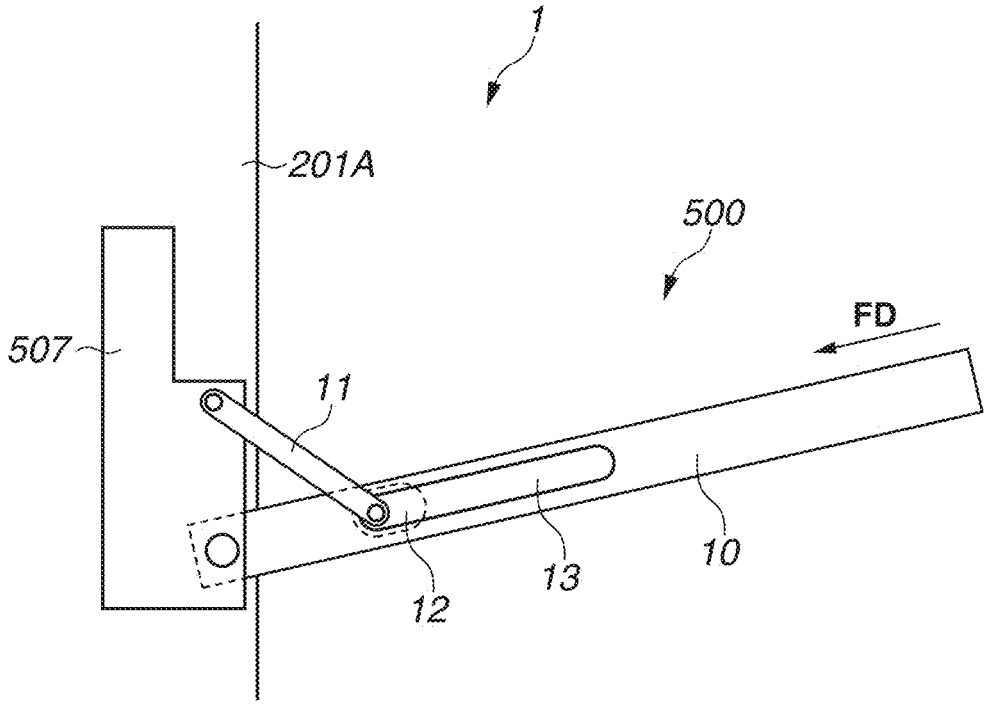
FIG. 3B is a front view of the manual feed tray at the opened position according to the exemplary embodiment, in which sheets and the feed unit are not illustrated.

In a predetermined time from the start of the blowing of the airs f1 and f2, the uppermost sheet S in a state where the adhesive force between the sheets is reduced is fed and conveyed by the rotating pickup roller 502 to the pair of separation rollers consisting of the feed roller 503 and the retard roller 504. The one sheet S separated by the pair of the separation rollers is conveyed by the pair of conveyance rollers 506 to the pair of registration rollers 240. FIGS. 3A and 3B, and the subsequent drawings do not illustrate the first side regulation part 70, the second side regulation part 80, the first air loosening part 74, and the second air loosening part 84. In the present exemplary embodiment, an example is described of the manual feed unit 500 including the first air loosening part 74 and the second air loosening part 84, but the present disclosure is not limited to this configuration.

[Support Configuration of Manual Feed Tray]

A configuration for holding the manual feed tray 10 at the opened position according to the present exemplary embodiment will now be described in detail with reference to FIGS. 3A to 7B. FIG. 3A is a front view of the manual feed tray 10 at the most opened position according to the present exemplary embodiment. FIG. 3B is a front view of FIG. 3A where the sheets S and the feed unit 507 are not illustrated.

The opened position of the manual feed tray 10 is held by the support arm 11. One end of the support arm 11 is pivotably supported by the apparatus main body 201A, and the other end is pivotably coupled to a first moving member 12 on one side of the manual feed tray 10. The first moving member 12 can move both upstream and downstream in the feeding directions FD in a tray rail 13 provided inside the manual feed tray 10. The tray rail 13 is an example of a guide part, which is an opening part formed in the frame of the manual feed tray 10 in the feeding direction FD as a longitudinal direction. In the present exemplary embodiment, the support arm 11 and the tray rail 13 are provided at both ends in the width direction W. However, they are not limited to being provided at both the ends, and can be provided only at one end.

The support arm 11 is an example of the holding member, one end of which is swingably supported by the apparatus main body 201A, and the other end is engaged with the manual feed unit 500. The first moving member 12 as an example of the guided part is guided along the tray rail 13 and moved with a pivot of the manual feed unit 500. The support arm 11 includes the first moving member 12 at the other end. When the manual feed unit 500 is at the opened position, the support arm 11 shares the load of the manual feed unit 500 between itself and the tray rail 13. In the present exemplary embodiment, while one end of the support arm 11 is swingably provided on the apparatus main body 201A, the supported part is not limited to the end, and the support arm 11 can be swingably supported by a part other than the end. Similarly, while the other end of the support arm 11 is coupled to the first moving member 12, the coupled part is not limited to the end, and the support arm can be coupled at a part other than the end. In the present exemplary embodiment, the first moving member 12 as the guided part is made of a different material from the support arm 11. However, the present disclosure is not limited to this configuration, and the guided part can be made of the same material as the support arm 11.

Figure 4:
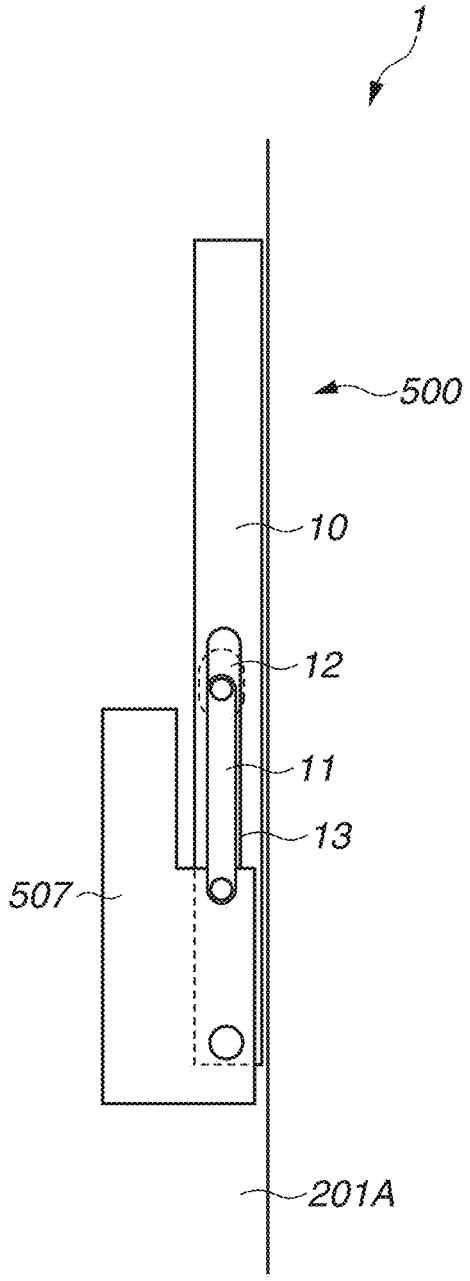
FIG. 4 is a plan view of the manual feed tray at a closed position according to the exemplary embodiment.
Figure 5A:
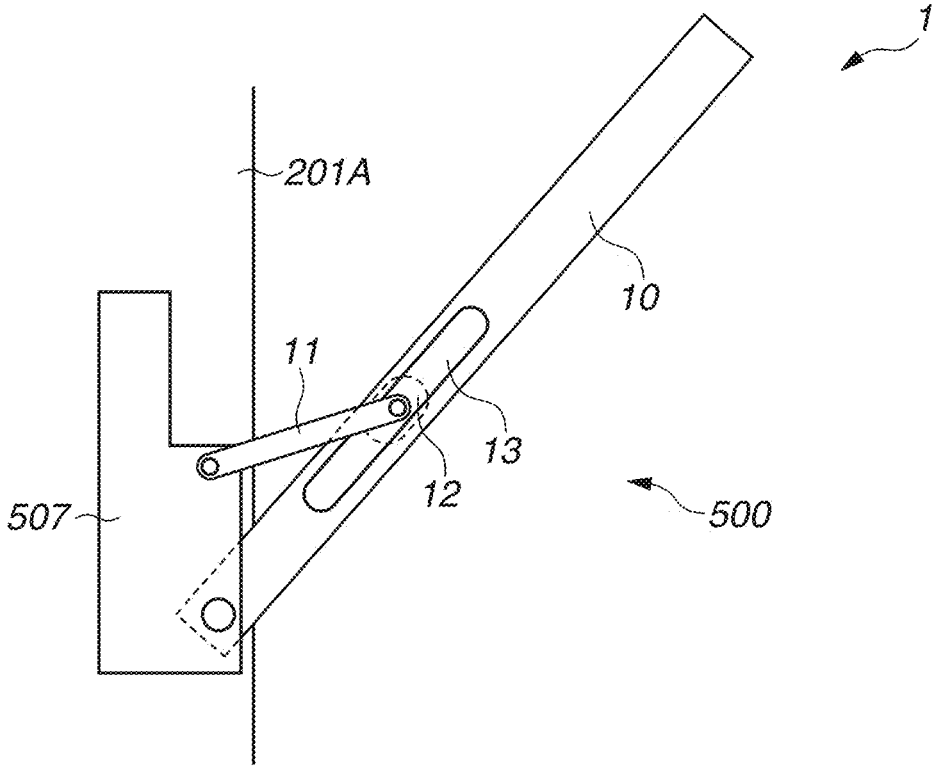
FIG. 5A is a front view of the manual feed tray at an intermediate position according to the exemplary embodiment.

The cooperation of the support arm 11 and the first moving member 12 while the manual feed tray 10 is opened or closed will now be described with reference to FIGS. 4 to 6B. FIG. 4 is a front view of the manual feed tray 10 at the closed position. The manual feed tray 10 can be shifted to an intermediate position between the closed position illustrated in FIG. 4 and the opened position illustrated in FIG. 5B. FIG. 5A illustrates the manual feed tray 10 at the intermediate position.

Figure 5B:
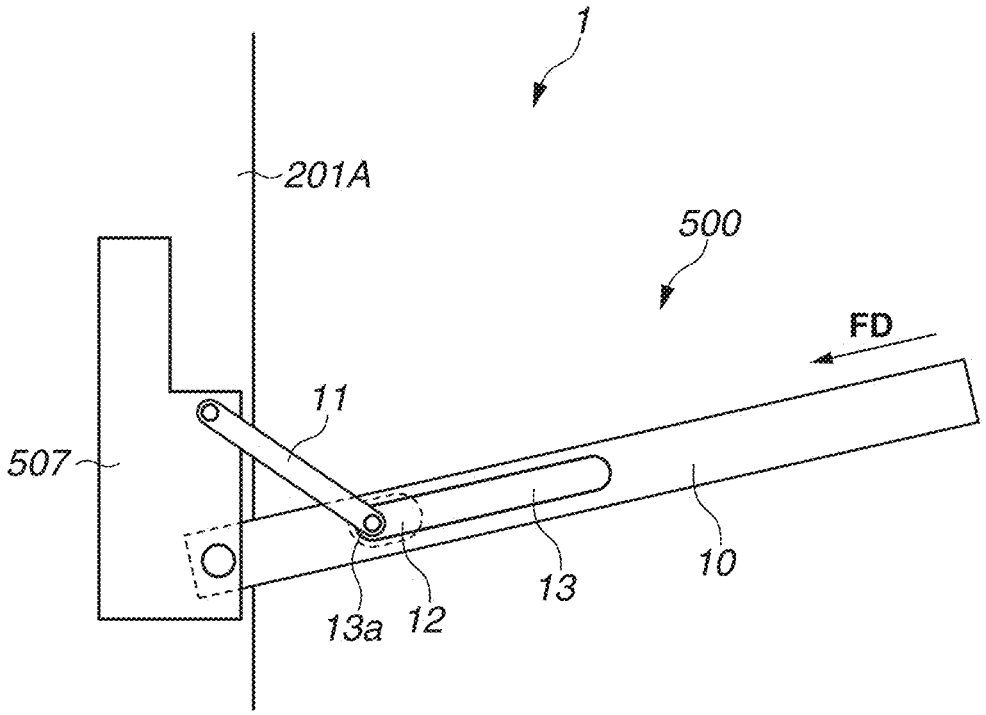
FIG. 5B is a front view of the manual feed tray at the opened position according to the exemplary embodiment.

When the manual feed tray 10 is opened to the intermediate position illustrated in FIG. 5A, the support arm 11 is pivoted, which moves the first moving member 12 in the tray rail 13. When the manual feed tray 10 is further opened, the end of the support arm 11 connected to the first moving member 12 comes into contact with a regulation part 13*a* of the tray rail 13 as illustrated in FIG. 5B, so that the sheets S are held in a stackable state. The regulation part 13*a* here is the end of the tray rail 13 downstream of the feeding direction FD.

[Damper Unit]

Figure 6:
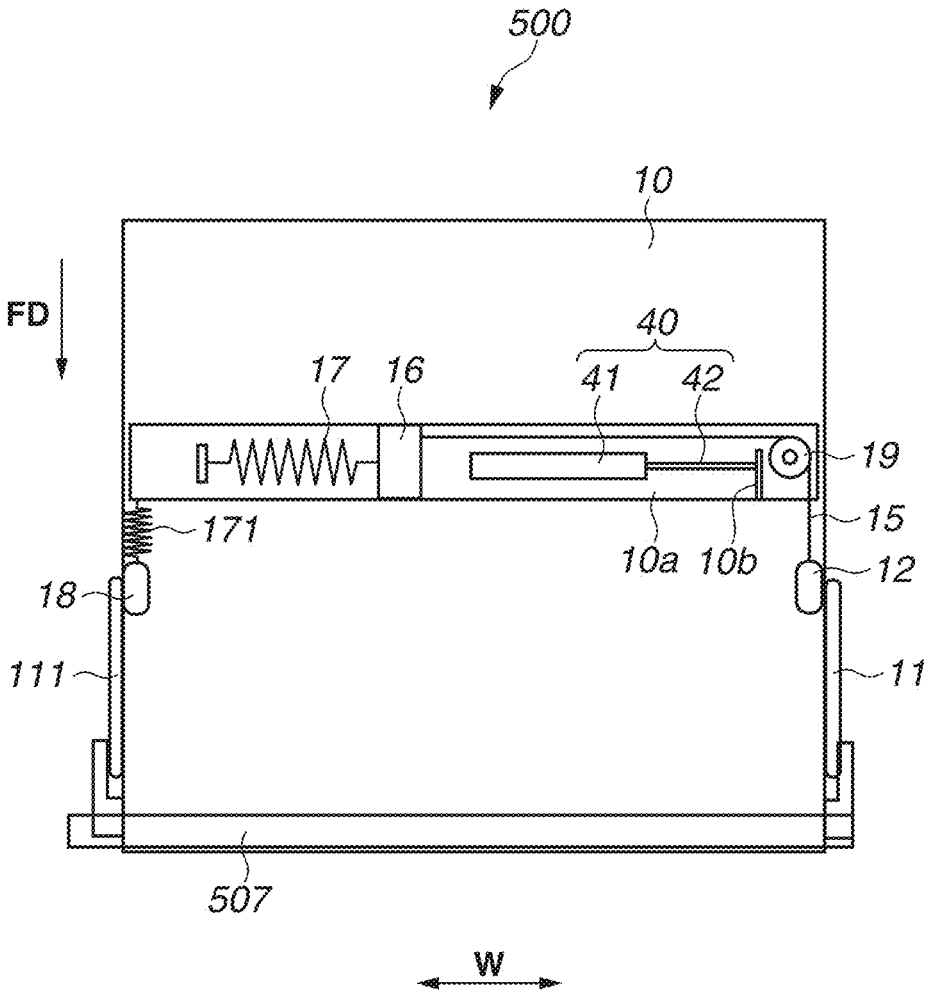
FIG. 6 is a cross-sectional view of the manual feed tray at the closed position according to the exemplary embodiment, when viewed from the direction opposite to the feeding direction of sheets on the manual feed tray.
Figure 7A:
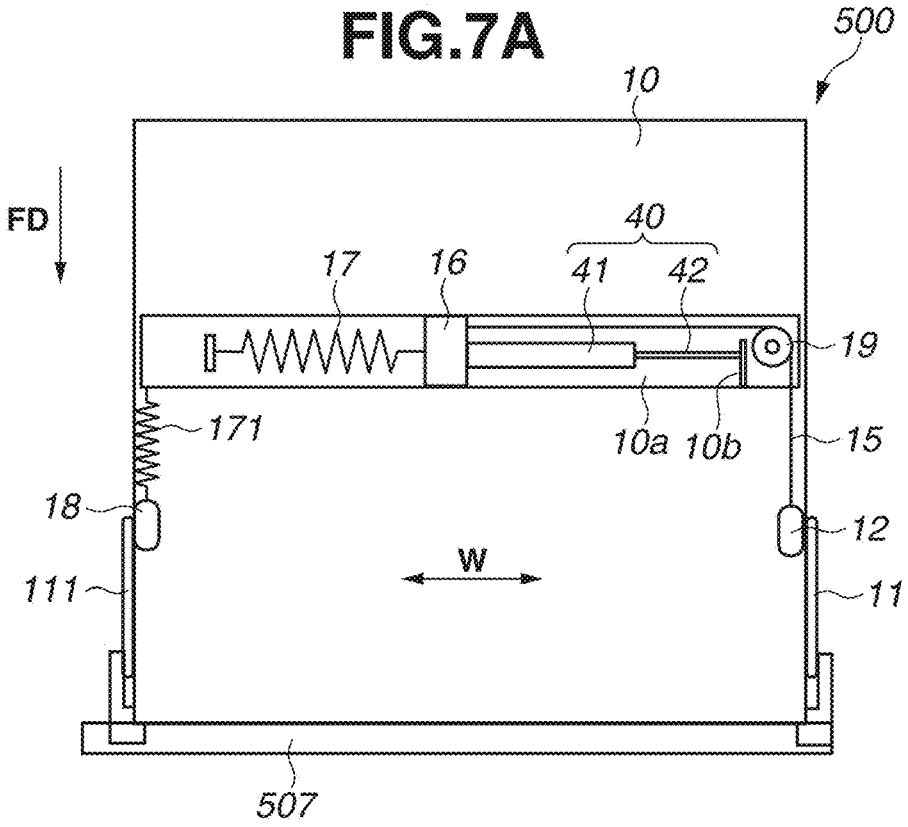
FIG. 7A is a cross-sectional view of the manual feed tray at the intermediate position according to the exemplary embodiment, when viewed from the direction opposite to the feeding direction of sheets on the manual feed tray.
Figure 7B:
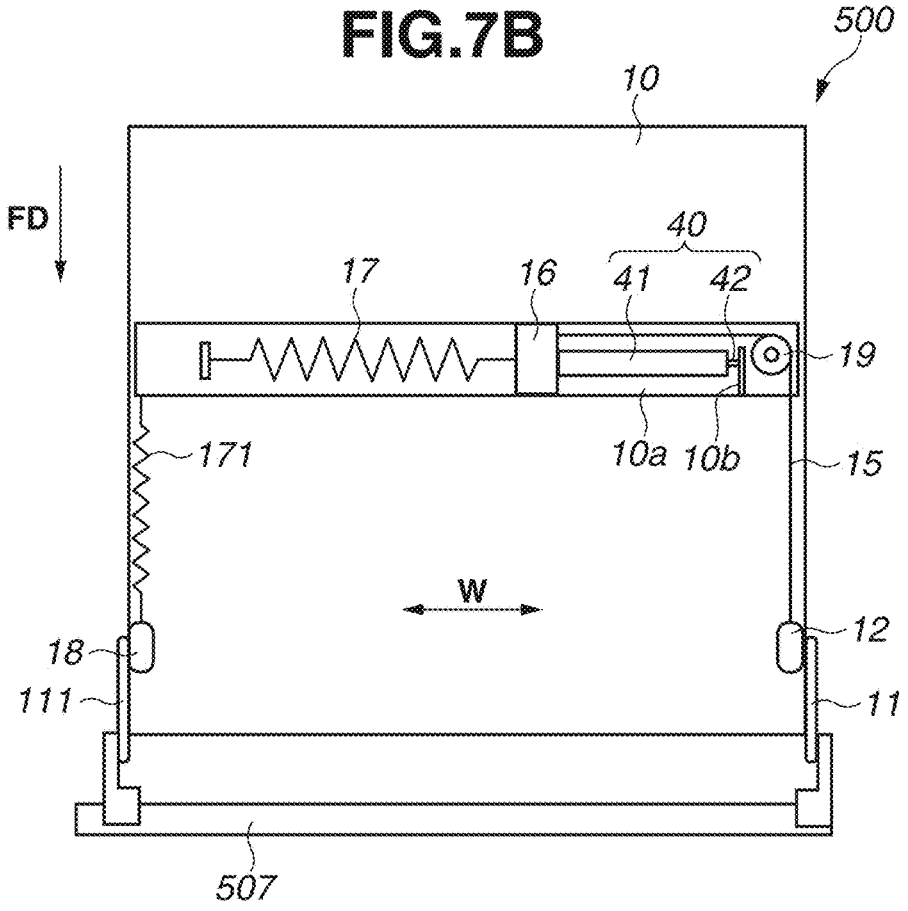
FIG. 7B is a cross-sectional view of the manual feed tray at the opened position according to the exemplary embodiment, when viewed from the direction opposite to the feeding direction of sheets on the manual feed tray.

In the present exemplary embodiment, the manual feed unit 500 includes a damper unit 40 as a damping part. In other words, the damper unit 40 is arranged in the manual feed unit 500. The damper unit 40 will be described in detail with reference to FIGS. 6 to 7B. FIGS. 6 to 7B are diagrams illustrating the inside of the manual feed tray 10 in sight of the side opposite to the sheet placement side.

FIG. 6 is a diagram illustrating a configuration of the damper unit 40 provided inside the manual feed tray 10. The manual feed tray 10 has a groove part 10*a* provided in the width direction W. The first moving member 12 pivotably connected to the support arm 11 is connected to a second moving member 16 with a cable 15 as a wire. The second moving member 16 as an abutment member is provided inside the groove part 10*a* movable in the width direction W.

The cable 15 connected between the first moving member 12 and the second moving member 16 midway changes its orientation by 90 degrees via a pulley 19. The second moving member 16 is movable together with the first moving member 12. More specifically, the portion of the cable 15 closer to the first moving member 12 than the pulley 19 is arranged extending in the feeding direction FD at the opened position, and the portion of the cable 15 closer to the second moving member 16 than the pulley 19 is arranged extending in the width direction W. The pulley 19 is an example of a winding part, which is provided in the manual feed unit 500 to wind and bend the cable 15.

In the groove part 10*a*, a fixed plate 10*b* is fixed to the manual feed tray 10. The damper unit 40 is provided between the second moving member 16 and the fixed plate 10*b*. The damper unit 40 is a device that generates a resistance force by the resistance of fluid, for example. In the present exemplary embodiment, the damper unit 40 is an air damper having an automatic return function. The damper unit 40 includes a cylinder part 41 as an example of a moving part and a rod part 42 as an example of a fixed part. The rod part 42 is fixed to the fixed plate 10*b*, thus being fixed to the manual feed tray 10. The cylinder part 41 and the rod part 42 are relatively movable in its axial direction. The cylinder part 41 here is movable relative to the rod part 42, and a resistance force is generated by the resistance of fluid resulting from a movement of the cylinder part 41. In the present exemplary embodiment, the damper unit 40 is expandable and contractable by the linear movement of the cylinder part 41 to the rod part 42, and is arranged so that the damper unit 40 extends and contracts in the width direction W.

The second moving member 16 and the cylinder part 41 are provided at positions where they can abut on and separate from each other. When the second moving member 16 is pulled by the cable 15 to move and be in contact with the cylinder part 41, the damper unit 40 generates a damping force.

Thus, the cable 15 couples the cylinder part 41 and the first moving member 12 via the second moving member 16 to transmit the resistance force. When the manual feed unit 500 pivots to move the first moving member 12 relative to the tray rail 13, the damper unit 40 generates a resistance force against the movement, resulting in damping the opening/closing speed of the manual feed unit 500.

When the rotation of the manual feed tray 10 and the movement of the first moving member 12 in the tray rail 13 are stopped, the damper unit 40 does not generate a resistance force.

In the present exemplary embodiment, the damper unit 40 is configured to work for one support arm 11 alone, and no damper unit is provided for a support arm 111 as the other support arm. However, the present disclosure is not limited to this configuration, and another damper unit can be provided for the other support arm 111.

A tension coil spring 17 is connected to the second moving member 16, which urges the second moving member 16 in the width direction W opposite to the damper unit 40. A tension coil spring 171 is connected to a third moving member 18 that is connected to the other support arm 111, and movable in the feeding direction FD to urge the third moving member 18 upstream in the feeding direction FD.

These tension coil springs 17 and 171 are both examples of an urging part, and urge the manual feed unit 500 in the direction to shift the manual feed unit 500 from the opened position to the closed position. In the present exemplary embodiment, the tension coil springs 17 and 171 urge the manual feed unit 500 in the direction to shift the manual feed unit 500 from the opened position to the closed position, even when the manual feed unit 500 is at any position in the range from the closed position to the opened position.

An operation of opening/closing the manual feed tray 10 will now be described. FIGS. 6, 7A and 7B illustrate the manual feed tray 10 at the closed position, the intermediate position, and the opened position, respectively. When the manual feed tray 10 is at the closed position illustrated in FIG. 6, the first moving member 12 is located upstream of the tray rail 13 in the feeding direction FD, and the second moving member 16 is located away from the damper unit 40.

When the manual feed tray 10 is opened and the first moving member 12 is moved to the position illustrated in FIG. 7A, the second moving member 16 is moved together with the first moving member 12 and abuts on the damper unit 40. When the manual feed tray 10 is further opened, the second moving member 16 compresses the damper unit 40, generating a damping force to slow down the opening speed of the manual feed tray 10.

In the present exemplary embodiment, the damper unit 40 is configured to generate a resistance force when the manual feed tray 10 pivots between the intermediate position and the opened position, and not to generate a resistance force when the manual feed tray 10 pivots between the closed position and the intermediate position. The position where the damper unit 40 and the second moving member 16 abut on each other can be designed arbitrarily, and the timing when the damper unit 40 starts to work can be adjusted.

When the manual feed tray 10 is opened to the opened position at the maximum angle, the first moving member 12 and the second moving member 16 move to the positions illustrated in FIG. 7B. At this time, the damper unit 40 operates in the most compressed state to generate a damping force that slows down the opening speed of the manual feed tray 10, which reduces the impact force on the regulation part 13*a* of the tray rail 13.

When the manual feed tray 10 is pivoted from the opened position to the closed position, the second moving member 16 is pulled by the tension coil spring 17, so that the cable 15 does not slacken. In addition, releasing the damper unit 40 from the pressure of the second moving member 16 can return to the state illustrated in FIG. 6 since the damper unit 40 has an automatic restoration function.

As described above, the manual feed unit 500 according to the present exemplary embodiment includes the damper unit 40, making it to reduce the impact generated when the manual feed tray 10 is pivoted to the opened position. Thus, the damper unit 40, and the first moving member 12 and the second moving member 16 that move in the manual feed tray 10 depending on the opening/closing movements of the manual feed tray 10 makes it possible to slow down the speed at which the manual feed tray 10 is opened, reducing the impact at the position where the manual feed tray 10 is held.

In particular, in the present exemplary embodiment, the manual feed unit 500 weights more because the fan motors 72 and 82 of the first air loosening part 74 and second air loosening part 84, and others, are included therein. A large impact would be generated when the manual feed unit 500 reaches the opened position without the damper 40, but the damper unit 40 can reduce the impact. Moreover, since the damper unit 40 is provided in addition to the urging springs, the manual feed tray 10 at the opened position can be urged toward the closed position by a small urging force, resulting in improved operability. This configuration can both reduce the impact and improve the operability.

In the manual feed unit 500 according to the present exemplary embodiment, the damper unit 40 is configured to generate a resistance force when the manual feed unit 500 is pivoted between the intermediate position and the opened position, and not to do it when the manual feed unit 500 is pivoted between the closed position and the intermediate position. This allows the manual feed tray 10 to be pivoted without a resistance force at the beginning of opening from the closed position, which avoids reduction in operability due to an unnecessarily large resistance at a position far from the occurrence of an impact.

In the manual feed unit 500 according to the present exemplary embodiment, the damper unit 40 and the tension coil springs 17 and 171 used in combination makes it possible to obtain an assist force for lifting the manual feed tray 10 when the manual feed tray 10 is closed from the opened position. Moreover, the tension coil springs 17 and 171 work in the entire movable range of the manual feed tray 10, which can avoid an abrupt pivot of the manual feed tray 10 from the closed position to the opened position.

In the manual feed unit 500 according to the present exemplary embodiment, the moving direction of the first moving member 12 and the expanding/contracting directions of the damper unit 40 are perpendicular to each other by using the cable 15 and the pulley 19. Without the cable 15 and the pulley 19, the expanding/contracting directions of the damper unit 40 would be in line with the feeding direction FD and its opposing direction, which can make the manual feed unit 500 larger in size in order to arrange the damper unit 40 so that the damper unit 40 does not interfere with the first air loosening part 74 or the second air loosening part 84. In contrast, in the present exemplary embodiment, the damper unit 40 can be arranged in the width direction W without interference with the first air loosening part 74 and/or the second air loosening part 84, which prevents the upsizing of the manual feed unit 500.

In the above-described exemplary embodiment, the load of the manual feed unit 500 is borne by the guided part and the guiding part, but the present disclosure is not limited to this configuration. The load of the manual feed unit 500 can be borne by a configuration other than the configuration with the guided part and the guiding part, and the guided part and the guiding part can be provided to couple the damper unit 40.

In the above-described exemplary embodiment, the sheet conveyance apparatus is the image forming apparatus 1, but the present invention is not limited to this application. For example, the present disclosure can be applied to a sheet supply apparatus that conveys sheets without the image forming unit 201B.

In addition, in the above-described exemplary embodiment, a linear damper that operates by being compressed is used as the damper unit 40. However, the present invention is not limited to this component, and a tension-type damper that operates in a pulling direction or a rotary damper can be used.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2023-145660, filed Sep. 7, 2023, which is hereby incorporated by reference herein in its entirety.

What is claimed is:

1. A sheet conveyance apparatus comprising:

a housing;

an opening/closing unit configured to be openably and closably provided with respect to the housing, and movable between a closed position at which the opening/closing unit is closed with respect to the housing and an opened position at which the opening/closing unit is opened with respect to the housing, the opened position being a feeding position in which a sheet is fed, and include a support part that supports the sheet at the opened position;

a feed unit configured to feed the sheet supported by the support part; and a damping unit that is included inside of the opening/closing unit and configured to damp a movement of the opening/closing unit when the opening/closing unit is moved from the closed position to the opened position, wherein the damping unit includes a rod and a cylinder containing fluid and movable relative to the rod, and the damping unit is configured to generate a resistance force by a resistance of fluid generated when the cylinder is moved.

2. The sheet conveyance apparatus according to claim 1, wherein the opening/closing unit is movable to an intermediate position in pivoting from the closed position to the opened position, wherein when the opening/closing unit is pivoted from the closed position to the intermediate position, the opening/closing unit is not subjected to a to the resistance force of applying a load to the movement of the opening/closing unit by the damping unit, and wherein when the opening/closing unit is pivoted from the intermediate position to the opened position, the opening/closing unit is subjected to the resistance force of applying the load to the movement of the opening/closing unit by the damping unit.

3. The sheet conveyance apparatus according to claim 1, further comprising a holding member that includes one end of the holding member engaged with the housing and the other end of the holding member engaged with the opening/closing unit and holds the opening/closing unit when the opening/closing unit is at the opened position, wherein the opening/closing unit includes a guiding part where, when the opening/closing unit is pivoted, a guided part provided at the other end of the holding member is guided, and wherein when the guided part moves relative to the guiding part, the opening/closing unit is subjected to the resistance force of applying a load to the movement of the opening/closing unit by the damping unit.

4. The sheet conveyance apparatus according to claim 3, wherein the holding member is subjected to the load of the opening/closing unit at one end of the guiding part when the opening/closing unit is at the opened position.

5. The sheet conveyance apparatus according to claim 1, wherein the opening/closing unit includes an urging part that urges the opening/closing unit in a direction of pivoting from the opened position to the closed position when the opening/closing unit is in a range from the closed position to the opened position.

6. The sheet conveyance apparatus according to claim 1, wherein the opening/closing unit further includes a cable one end of which is connected to a guided part, an abutment position that is connected to another end of the cable and configured to abut on the cylinder to move the cylinder, an abutment member movable to a separate position where the abutment member is separated from the cylinder, and a winding part on which the cable is wound and bent between the guided part and the abutment member.

7. The sheet conveyance apparatus according to claim 1, wherein the damping unit is extendable and contractable by linearly movement of the cylinder relative to the rod, and is arranged such that extending/contracting directions of the damping unit is in a width direction perpendicular to a feeding direction of the sheet.

8. The sheet conveyance apparatus according to claim 1, wherein the opening/closing unit includes an air blowing part configured to blow air onto the sheet supported by the support part.

9. An image forming apparatus comprising:

the sheet conveyance apparatus according to claim 1; and an image forming unit configured to form an image on a sheet conveyed by the feed unit.

10. The sheet conveyance apparatus according to claim 1, wherein when the opening/closing unit is in the closed position, the opening/closing unit is not subjected to the resistance force of applying a load to the movement of the opening/closing unit by the damping unit.

11. The sheet conveyance apparatus according to claim 1, wherein the opening/closing unit has a space inside, and the damping unit is arranged inside.

* * * * *